US005112254A

United States Patent [19]

Endo

[11] Patent Number: 5,112,254

[45] Date of Patent: May 12, 1992

[54] ELECTRICAL CONTACTS

[75] Inventor: Hiroshi Endo, Tokyo, Japan

[73] Assignee: Japan Aviation Electronics Industry, Ltd., Tokyo, Japan

[21] Appl. No.: 436,616

[22] Filed: Nov. 15, 1989

[30] Foreign Application Priority Data

Dec. 5, 1988 [JP] Japan ..... 63-157705[U]

[51] Int. Cl.[5] ..... H01R 11/22

[52] U.S. Cl. ..... 439/852; 439/856

[58] Field of Search ..... 439/816, 839, 842, 843, 439/844, 845, 849, 850, 851, 852, 853, 855, 858, 861, 862

[56] References Cited

U.S. PATENT DOCUMENTS

| | | | |
|---|---|---|---|
| 1,231,417 | 6/1917 | Nero | 439/839 |
| 3,299,396 | 1/1967 | Kinkaid | 439/862 |
| 3,836,947 | 9/1974 | Yeager | 439/852 |
| 4,540,233 | 9/1985 | Saijo et al. | 439/839 |

*Primary Examiner*—Larry I. Schwartz
*Assistant Examiner*—Hien D. Vu
*Attorney, Agent, or Firm*—Bierman and Muserlian

[57] ABSTRACT

This invention relates to an electrical socket contact, and more particularly to a solderless electrical wire terminal of a socket connector which can be formed from a sheet of conductive material and a portion for receiving a pin contact element is completely surrounded by four side walls.

1 Claim, 2 Drawing Sheets

ELECTRICAL CONTACTS

FIELD OF THE INVENTION

This invention relates generally to electrical contacts, and more particularly to electrical socket contacts.

BACKGROUND OF THE INVENTION

The invention relates to an electric socket contact to be connected with a pin contact, which can be manufactured from a strip or sheet of conductive material by means of press or forming machine.

In general, it is desirable to make electric socket contact so as to protect a contact spring section including two resilient arms which are used to connect a pin contact element from surroundings. To this end, usually, the contact spring section is surrounded by three sides, that is, the opposing side walls and an upper wall which can be formed by bending the strip. According to this type of a conventional socket contact, the back side of the contact spring section is not completely surrounded by the side walls, and therefore it is a disadvantage that the pin contact element is frequently inserted between the back of the contact spring section and a wall of the casing.

SUMMARY OF THE INVENTION

Accordingly, the principal object of the present invention to provide a new and improved electrical socket contact having good structural integrity in which the contact spring section is completely surrounded by four side walls which are of a generally box-like configuration.

BRIEF DESCRIPTION OF THE DRAWING

A more complete appreciation of the present invention and many of the attendant advantages thereof will be readily appreciated as the same become better understood by reference to the following detailed description when considered in connection with the accompanying drawing, wherein.

DESCRIPTION OF THE PREFERRED EMBODIMENT

Figure 1:
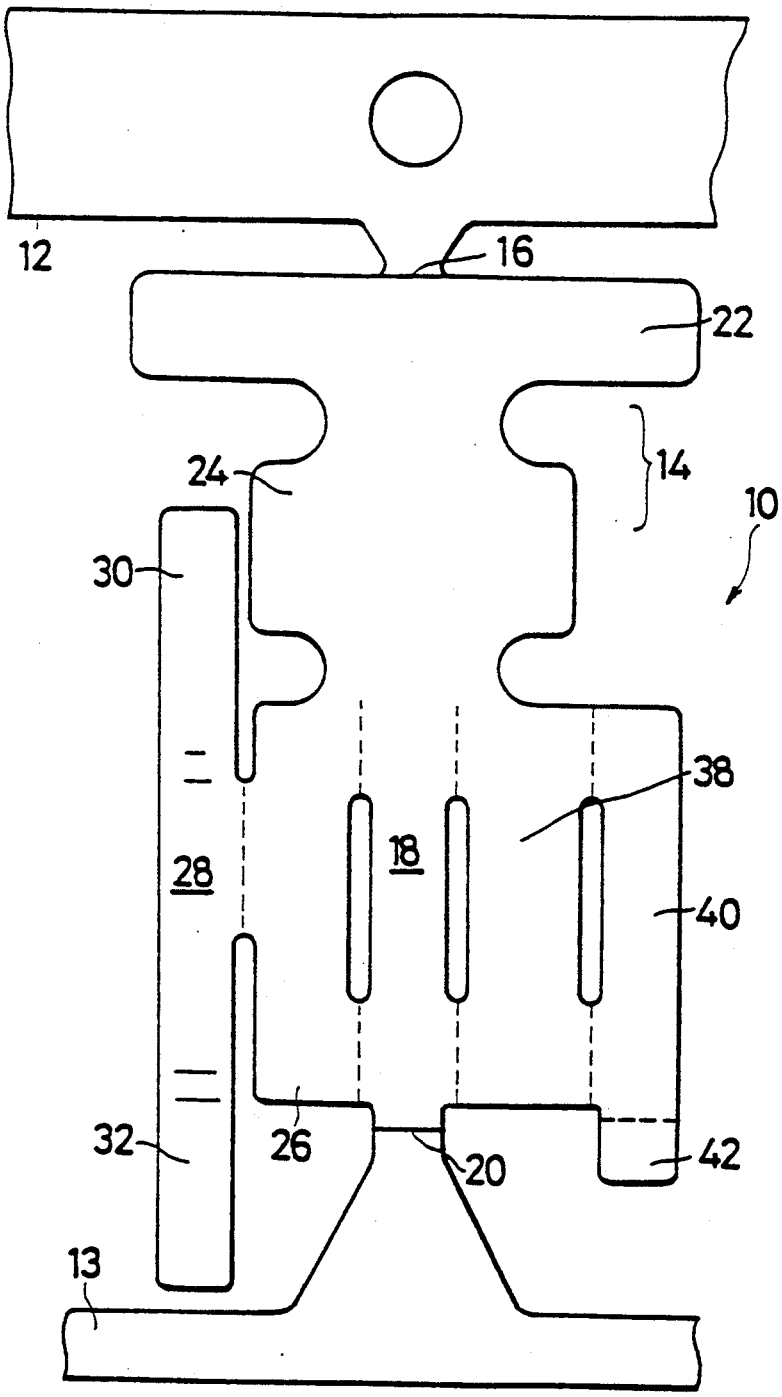
FIG. 1 is a plan view of the socket contact of the present invention attached to carrier strips at one stage of manufacture thereof.

Referring now in detail to the drawings, wherein like reference characters designate identical or corresponding parts throughout the several views, and more particularly to FIG. 1 wherein an electrical socket contact of the present invention is illustrated generally at 10 attached to the first and second carrier strips 12 and 13. The contact 10 has undergone a first step of manufacture wherein the contact and associated carrier strips have been punched from a strip or sheet of conductive material, and wherein one of the ends to form a solderless electrical wire receiving portion 14 has been formed by providing a first break line 16 between the contact 10 and the first carrier strip 12. In the same manner as the above, a second break line 20 is provided between a center contact arm which forms a base portion 18 of the contact 10 and the second carrier strip 13.

Figure 2:
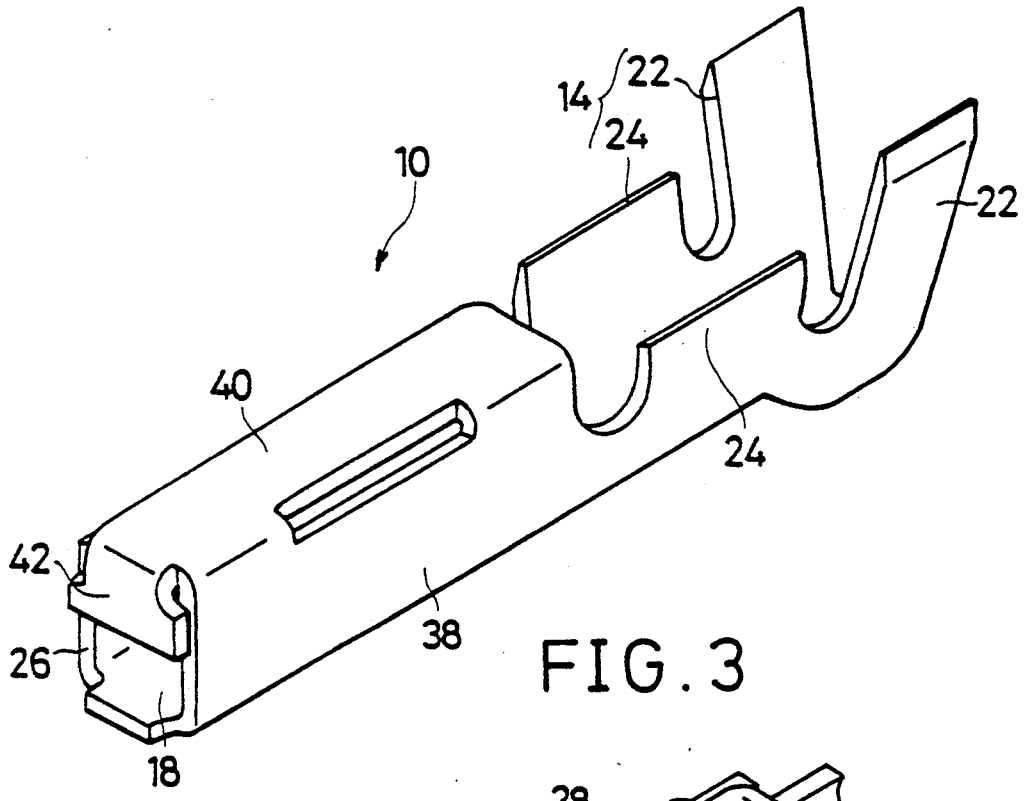
FIG. 2 is a perspective view of the electric socket contact of the present invention.

As shown in FIG. 2, in order to form the contact 10 into the shape as actually used, the portions are respectively bent in opposed directions.

Figure 3:
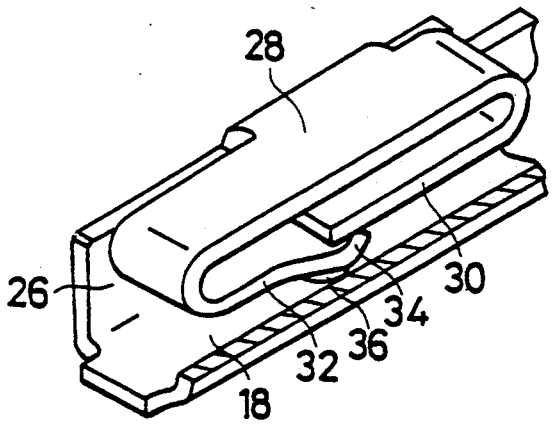
FIG. 3 is a partial sectional view illustrating a spring section with cutting off one of the side walls.

As illustrated in FIGS. 2 and 3, when the contact 10 is in the fully formed condition, the wire receiving portion 14 is formed by an insulation cover holding portion 22 and a wire contact portion 24.

A first side flange which is parallel with the base portion 18 is bent to at an angle of 90° with the base portion 18 to form a first side wall 26 and a side portion which is parallel with the first side wall 26 is bent to at an angle of 90° with the first side wall 26 to form a spring base 28. Both ends of the spring base 28 are respectively bent in U-configuration to form an inner spring arm 30 and an outer spring arm 32. The outermost end of each of the inner and outer arms 30 and 32 is partially overlapped each other. In order to contact tightly the outer spring arm 32 of the connector of the present invention with a pin contact (not shown) inserted into the socket contact, the spring arm 32 is preferably provided with a protruded contact portion 34 and a nose portion 36.

A second side flange which is opposite to the first side flange and parallel with the base portion 18 is bent at an angle of 90° to form a second side wall 38. A third side flange adjacent to the second side wall 38 is inwardly bent at an angle of 90° to form a top wall 40. An end of the top wall 40 is longitudinally toward the second carrier strip 13 and bent at an angle of 90° to form a front cover 42 of an opening into which the pin contact is inserted.

It will be understood from the foregoing, the socket contact of the present invention can be formed by punching from a flat strip or sheet of conductive material. The socket contact may be formed by the base portion 18, the second and third side walls 26 and 38 which are respectively bent from each side of the base portion, the spring base 28 which is inwardly bent from the first side wall 26 and the inner and outer spring arms 30 and 32 which are respectively folded in U-like form from each end of the spring base portion 28 so as to overlap each other. In addition to the above, the top wall 40 can enclose the spring base portion 28 from the outside thereof, and the spring arms 30 and 32 are completely surrounded by the base portion 18, the side walls 26 and 38 and the top wall 40. And also the inner and outer spring arms 30 and 32 are respectively protected by the front cover 42 from the outside of the opening into which the pin contact is inserted.

Consequently, the spring arms 30 and 32 which are essential in contact with the pin contact are protected against an exterior force and the pin contact can be inserted into between them precisely.

While the preferred form of the present invention has been described, it is to be understood that modifications will be apparent to those skilled in the art without departing from the spirit of the invention.

The scope of the invention, therefore, is to be determined soley by the following claims.

What is claimed is:

1. In an electrical socket contact adapted to receive a pin contact element, the socket contact being formed from a single sheet of conductive material comprising a base portion, first and second side walls which are respectively folded from each side of the base portion, and a spring base which is bent from the outside of the first side wall; the improvement comprising free ends of the spring base being respectively bent in U-form to overlap each other for receiving the pin contact element between one of the U-shaped ends and the base portion and for making electrical contact therewith, an outside portion of the second side wall being inwardly bent at a right angle from the second side wall to form a top wall for surrounding the backside of the spring base from the outside, and a portion of one end of the top wall being inwardly bent at a right angle to form a front cover to prevent the pin contact element from inserting into a space between the backside of the spring base and the top wall.

* * * * *